US007823226B2

(12) United States Patent
Chou

(10) Patent No.: US 7,823,226 B2
(45) Date of Patent: Nov. 2, 2010

(54) STRAP ADJUSTING DEVICE FOR SWIMMING GOGGLES

(76) Inventor: Terry Chou, No. 12, Hsin Ho Herng Road, Tainan City (TW)

( * ) Notice: Subject to any disclaimer, the term of this patent is extended or adjusted under 35 U.S.C. 154(b) by 518 days.

(21) Appl. No.: 12/032,662

(22) Filed: Feb. 16, 2008

(65) Prior Publication Data

US 2009/0205115 A1 Aug. 20, 2009

(51) Int. Cl.
*A61F 9/02* (2006.01)

(52) U.S. Cl. ..... 2/448; 2/452; 24/68 E

(58) Field of Classification Search ..... 2/448, 2/452; 24/68 E, 170, 191, 196
See application file for complete search history.

(56) References Cited

U.S. PATENT DOCUMENTS 6,966,102 B2 * 11/2005 Shiue ..... 24/196
7,251,842 B1 * 8/2007 Chiang ..... 2/445
7,640,633 B2 * 1/2010 Chou ..... 24/68 E

* cited by examiner

*Primary Examiner*—Katherine Moran
(74) *Attorney, Agent, or Firm*—Banger Shia

(57) ABSTRACT

A strap adjusting device includes a buckle having two through-holes spaced by a partitioning wall. A pressing member is slideably and rotatably received in each through-hole. The pressing members are movable relative to the buckle to adjust a distance between each pressing member and a pressing edge in each through-hole. At least one resilient strap is mounted to a body of a pair of swimming goggles and includes two ends each of which is wound around one of the pressing members. The strap is pullable to adjust tightness of the strap when the pair of swimming goggles is worn on the head of the user. The pulling force acting on the strap urges each pressing member to move toward one of the pressing edges to tightly clamp the strap and to fix a length of the strap.

7 Claims, 15 Drawing Sheets

STRAP ADJUSTING DEVICE FOR SWIMMING GOGGLES

BACKGROUND OF THE INVENTION

1. Field of the Invention

The present invention relates to a strap adjusting device for swimming goggles and, more particularly, to a strap adjusting device allowing easy adjustment of a length of a strap while providing reliable clamping effect.

2. Description of the Related Art

A pair of swimming goggles includes a length-adjustable strap and a buckle to which the strap is mounted. FIGS. 12 and 13 show a resilient strap 1' and a conventional buckle 2' made of a rigid material. The buckle 2' includes two coupling portions 21' and 22' to which two ends 11' and 12' of the strap 1' are mounted. Each coupling portion 21', 22' includes a notch 211', 221' and two parallel, spaced pegs 212' and 213', 222' and 223'. Each end 11', 12' of the strap 1' can be extended into the buckle 2' via the notch 211', 221', wound around the pegs 212' and 213', 222' and 223', and then extended out of the buckle 2' via the notch 211', 221'. The strap 1' can be pulled to tighten the strap 1' on the pegs 212' and 213', 222' and 223' to thereby fix the length and the tightness of the strap 1'.

With reference to FIG. 14, when adjustment of the length and the tightness of the strap 1' is required, the strap 1' is loosened from the pegs 212' and 213', 222' and 223'. Next, the strap 1' is pulled at the ends 11' and 12' to adjust the length and hence the tightness of the strap 1'. However, since each end 11', 12' of the strap 1' is wound twice around the buckle 2', leading to troublesome assembly and troublesome adjustment of the strap 1'. FIG. 15 shows a pair of swimming goggles 3' utilizing the strap 1' and the buckle 2' of FIG. 12. When the pair of swimming goggles 3' is worn on a head of a user, it is difficult for the user to reach the buckle 2' and to adjust the strap 1'. Specifically, adjustment of the tightness of the strap 1' is generally accomplished after the pair of swimming goggles 3' is removed from the head of the user.

A need exists for a strap adjusting device allowing easy adjustment of a length of a strap of a pair of swimming goggles while providing reliable clamping effect.

BRIEF SUMMARY OF THE INVENTION

A strap adjusting device for a pair of swimming goggles according to the preferred teachings of the present invention includes a buckle having first and second through-holes spaced by a partitioning wall. Each of the first and second through-holes includes an outer wall facing the partitioning wall and having a pressing edge. Each of the first and second through-holes further includes two opposite sidewalls perpendicular to the outer wall. Each sidewall of the first through-hole includes a first receiving portion, and each sidewall of the second through-hole includes a second receiving portion. First and second pressing members are respectively received in the first and second through-holes. The first pressing member separates the first through-hole into a first inner slot adjacent the partitioning wall and a first outer slot distant to the partitioning wall. The second pressing member separates the second through-hole into a second inner slot adjacent the partitioning wall and a second outer slot distant to the partitioning wall. Two ends of the first pressing member are slideably and rotatably received in the first receiving portions. Two ends of the second pressing member are slideably and rotatably received in the second receiving portions. The first and second pressing members are movable relative to the buckle to adjust a distance between each of the first and second pressing members and one of the pressing edges. At least one resilient strap is adapted to be mounted to a body of a pair of swimming goggles and includes two ends. One of the two ends of the at least one resilient strap is extended through the first inner slot and the first outer slot and wound around the first pressing member. The other end of the at least one resilient strap is extended through the second inner slot and the second outer slot and wound around the second pressing member. The at least one resilient strap includes first and second outer portions respectively adjacent the ends of the at least one resilient strap. The at least one resilient strap further includes first and second clamping portions adapted for clamping a head of a user wearing the pair of swimming goggles. The first and second outer portions are pullable by a force to adjust tightness of the strap when the pair of swimming goggles is worn on the head of the user. The force acting on the strap urges each of the first and second pressing members to move toward one of the pressing edges to tightly clamp the strap and to fix a length of the strap.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
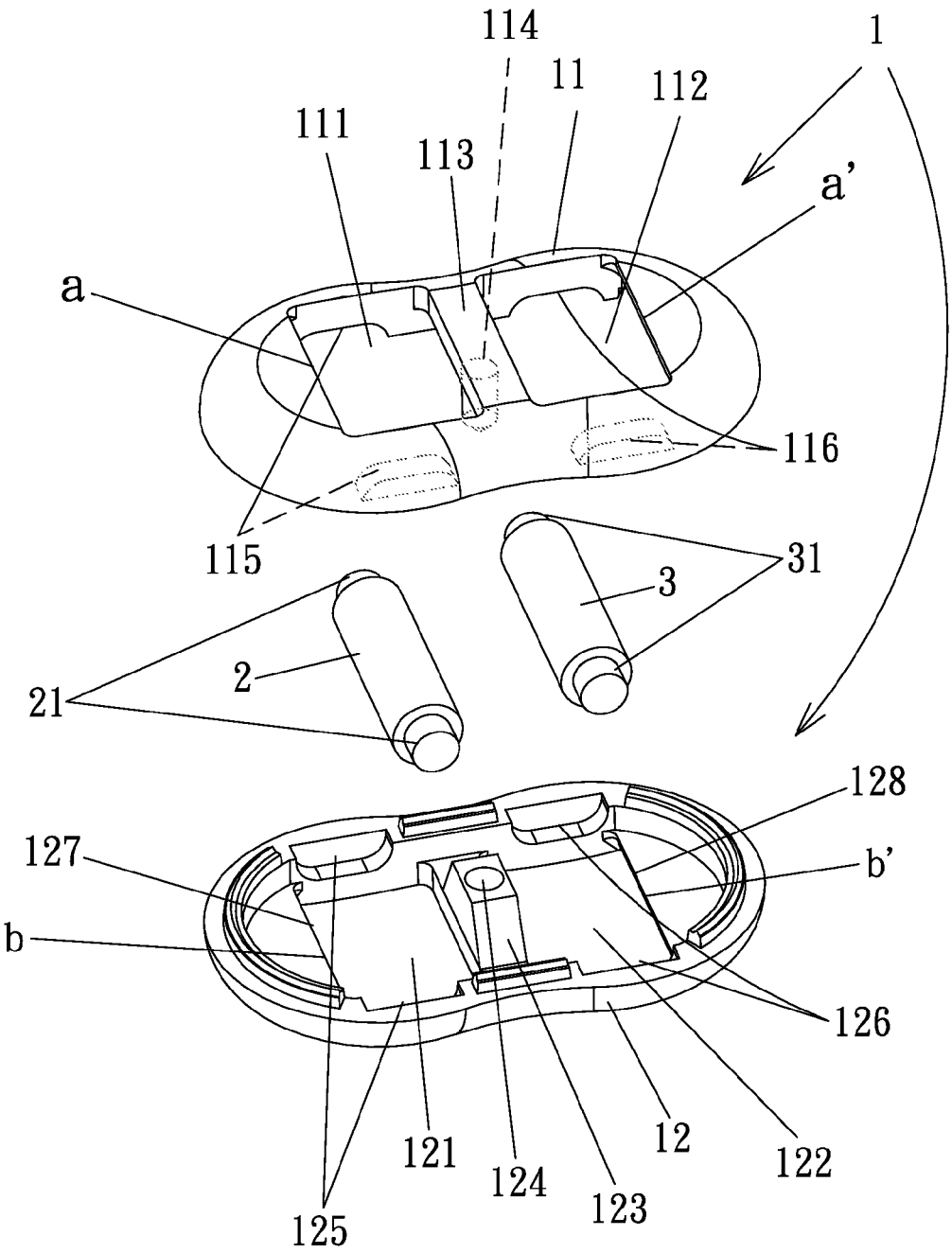
FIG. 1 shows an exploded perspective view of a strap adjusting device of a first embodiment according to the preferred teachings of the present invention.
Figure 2:
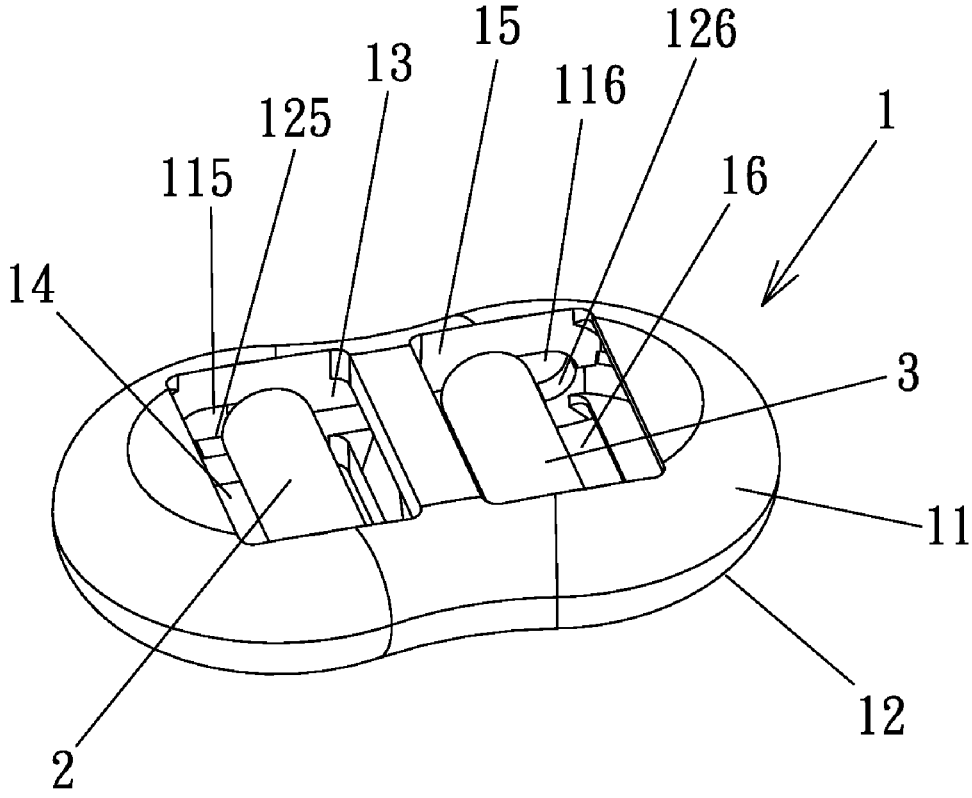
FIG. 2 shows a perspective view of the strap adjusting device of FIG. 1.
Figure 3:
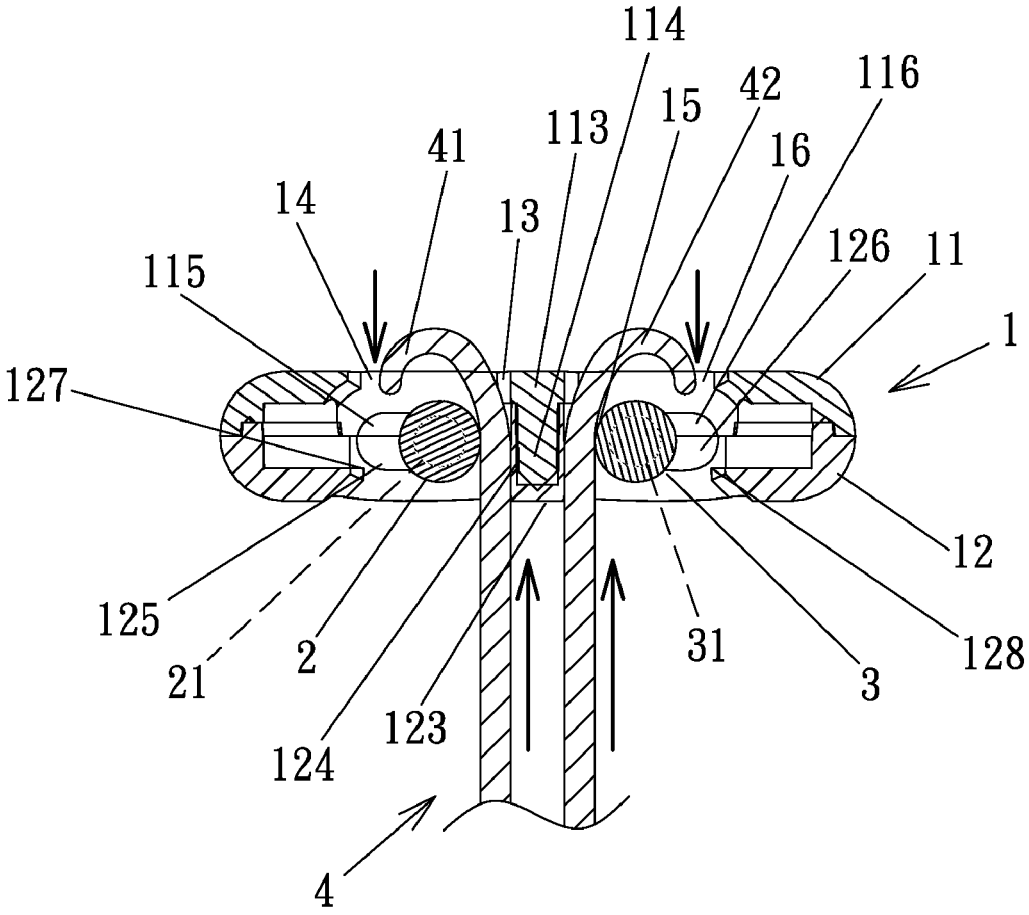
FIG. 3 shows a cross-sectional view of the strap adjusting device of FIG. 1 with two ends of a strap being extended through the strap adjusting device.

With reference to FIGS. 1 through 3, a strap adjusting device of a first embodiment according to the preferred teachings of the present invention includes a buckle 1 and two pressing members 2 and 3. The buckle 1 includes upper and lower portions 11 and 12 coupled with each other. Each portion 11, 12 includes left and right through-holes 111 and 112, 121 and 122 spaced by a partitioning wall 113, 123. Each through-hole 111, 121 of the upper portion 11 includes an outer wall a, $a_i^-$ facing the partitioning wall 113. Each through-hole 121, 122 of the lower portion 12 includes an outer wall b, $b_i^-$ facing the partitioning wall 123 The upper portion 11 includes a protrusion 114 formed on the partitioning wall 113, and the lower portion 12 includes a groove or hole 124 formed in the partitioning wall 123 and receiving the protrusion 114 to enhance assembling reliability. However, in an alternatively example, the upper portion 11 can include a hole, and the lower portion 12 can include a protrusion engaged in the hole of the upper portion 11. The upper portion 11 further includes a first receiving portion 115 on each of two opposite sidewalls that define the left through-hole 111 and that are perpendicular to the outer wall a. The upper portion 11 further includes a second receiving portion 116 on each of two opposite sidewalls that define the right through-hole 112 and that are perpendicular to the outer wall $a_i^-$. The lower portion 12 further includes a third receiving portion 125 on each of two opposite sidewalls that define the left through-hole 121 and that are perpendicular to the outer wall b. The lower portion 12 further includes a fourth receiving portion 126 on each of two opposite sidewalls that define the right through-hole 122 and that are perpendicular to the outer wall $a_i^-$. According to the preferred form shown the first, second third and fourth receiving portions 115, 116, 125, and 126 are in the form of elongated grooves. Each outer wall b, $b_i^-$of the lower portion 12 includes a pressing edge 127, 128 with appointed section. After assembly of the upper and lower portions 11 and 12, the left through-hole 111 of the upper portion 11 is aligned with the left through-hole 121 of the lower portion 12, and the right through-hole 112 of the upper portion 11 is aligned with the right through-hole 122 of the lower portion 12. Furthermore, one of the first receiving portions 115 of the upper portion 11 and one of the third receiving portions 125 of the lower portion 12 together define a first guide groove. The other first receiving portion 115 of the upper portion 11 and the other third receiving portion 125 of the lower portion 12 together form a second guide groove aligned with and spaced from the first guide groove in a direction parallel to the outer wall a and perpendicular to the left through-hole 111, 121. Further, one of the second receiving portions 116 of the upper portion 11 and one of the fourth receiving portions 116 together form a third guide groove spaced from the first guide groove in a direction perpendicular to the outer wall ah Further, the other second receiving portion 116 of the upper portion 11 and the other fourth receiving portion 126 of the lower portion 12 together define a fourth guide groove aligned with and spaced from the second guide groove in a direction parallel to the outer wall ahand perpendicular to the right through-hole 112, 122.

Each pressing member 2, 3 is a rigid, cylindrical member with two ends 21, 31 slideably and rotatably received in the receiving portions 115 and 125, 116 and 126 (i.e., the first, second, third, and fourth guide grooves). The upper and lower portions 11 and 12 are fixed together by gluing or other methods after the pressing members 2 and 3 are mounted in the left and right through-holes 111, 112, 121, 122. The right through-hole 111, 121 is separated by the pressing member 2 into an inner slot 13 adjacent the partitioning wall 113, 123 and an outer slot 14 distant to the partitioning wall 113, 123. The left through-hole 112, 122 is separated by the pressing member 3 into an inner slot 15 adjacent the partitioning wall 113, 123 and an outer slot 16 distant to the partitioning wall 113, 123. According to the preferred form shown, the ends 21, 31 of each pressing member 2, 3 are cylindrical to allow smooth sliding and rotational movement of the ends 21, 31 of the pressing member 2, 3 in the associated receiving portions 115, 125, 116, and 126.

Figure 4:
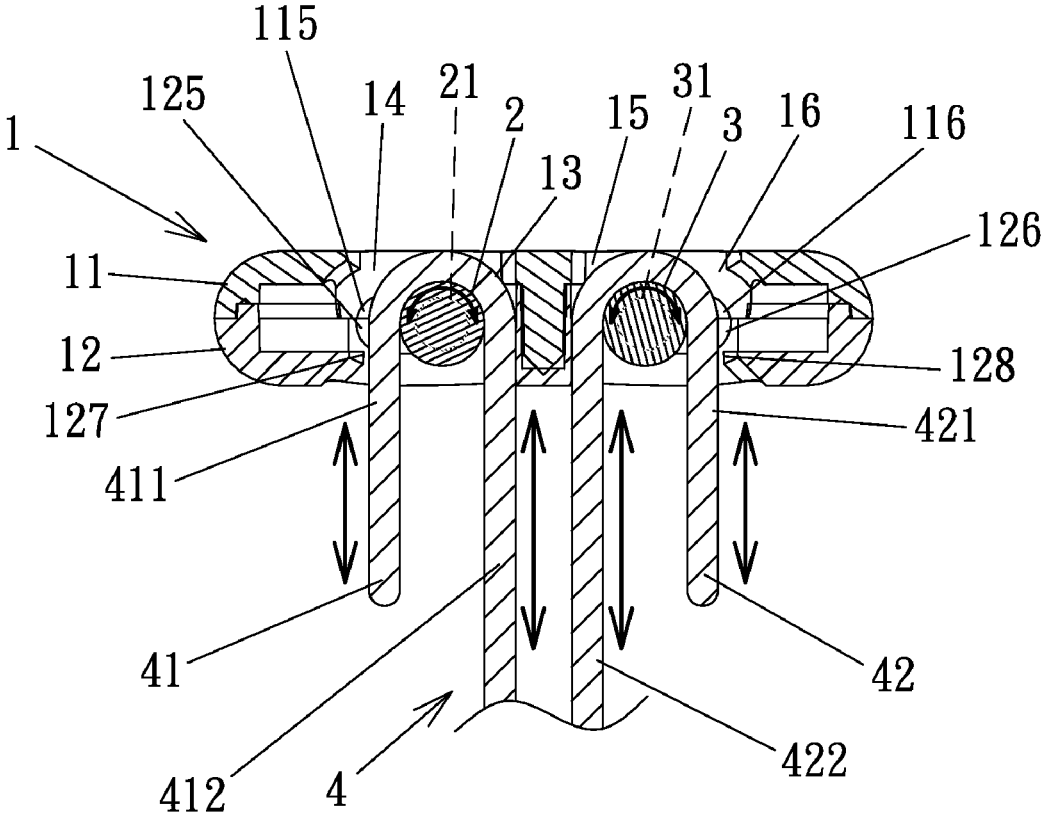
FIG. 4 shows a cross-sectional view of the strap adjusting device and the strap of FIG. 3, illustrating adjustment of a length of the strap.

A strap 4 includes two ends 41and 42 respectively inserted into the inner slots 13 and 15 and then wound around the pressing members 2 and 3 (FIG. 3). Each end 41, 42 of the strap 4 is then extended out of the buckle 1 via one of the outer slots 14 and 16. With reference to FIG. 4, after winding around the pressing members 2 and 3, the strap 4 includes two outer portions 411 and 421 each of which is adjacent one of the ends 41, 42 and two clamping portions 412 and 422 for clamping purposes. When the outer portions 411 and 421 and the clamping portions 412 and 422 are spaced from and parallel to each other, a user can pull the ends 41 and 42 of the strap 4 to adjust the length of the strap 4 (FIG. 4). During adjustment of the length of the strap 4, the ends 21 and 31 of the pressing members 2 and 3 rotate in the receiving portions 115, 125, 116, and 126. Thus, adjustment of the length of the strap 4 can be accomplished smoothly.

Figure 5:
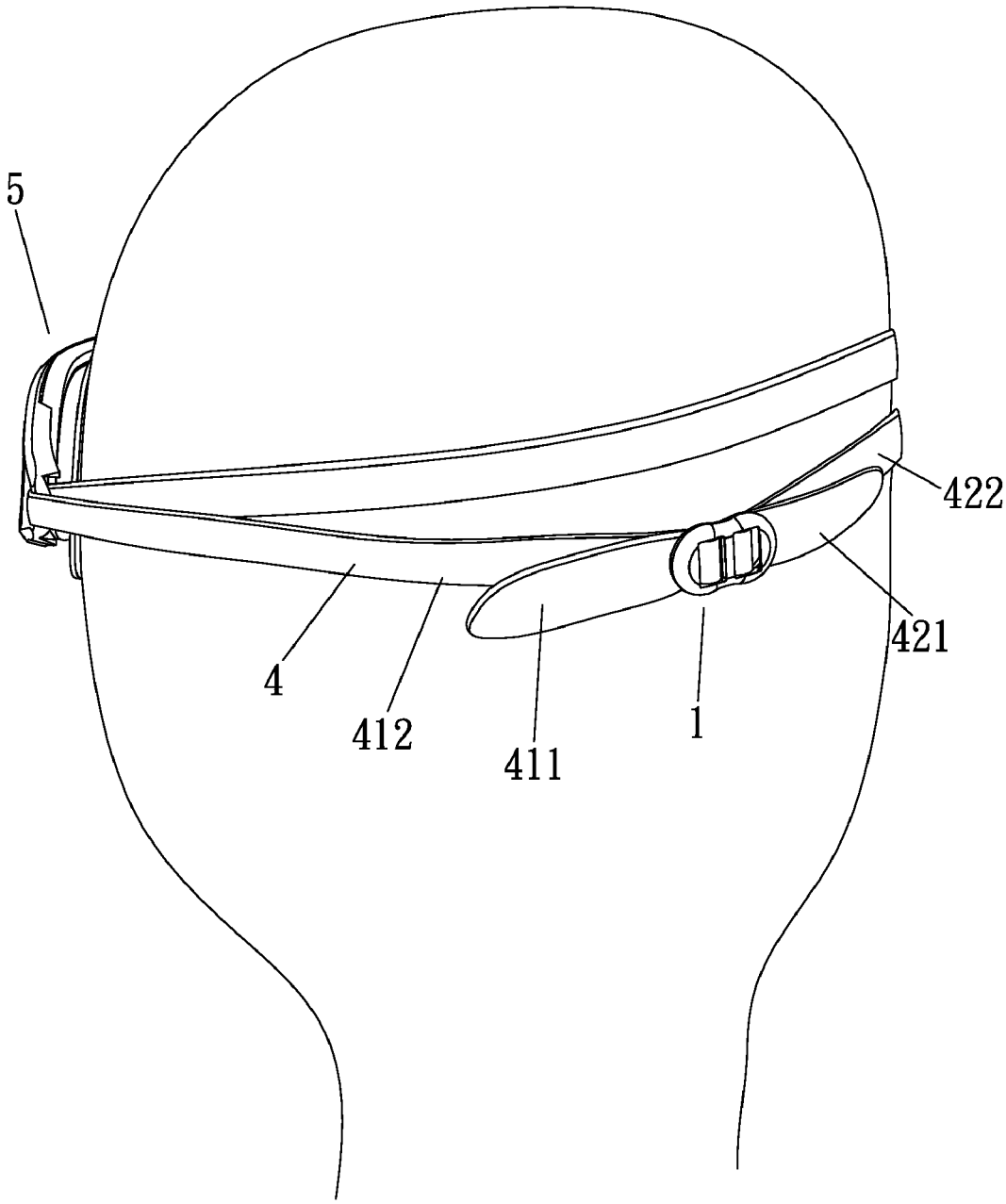
FIG. 5 shows a schematic perspective view of a pair of swimming goggles utilizing the strap adjusting device and the strap of FIG. 4 and worn on a head of a user.

With reference to FIG. 5, the strap 4 can be coupled with a body 5 of a pair of swimming goggles. When the pair of swimming goggles is worn on a head of a user, the outer portions 411 and 421 and the clamping portions 412 and 422 extend away from the buckle 1 in parallel relationship.

Figure 6:
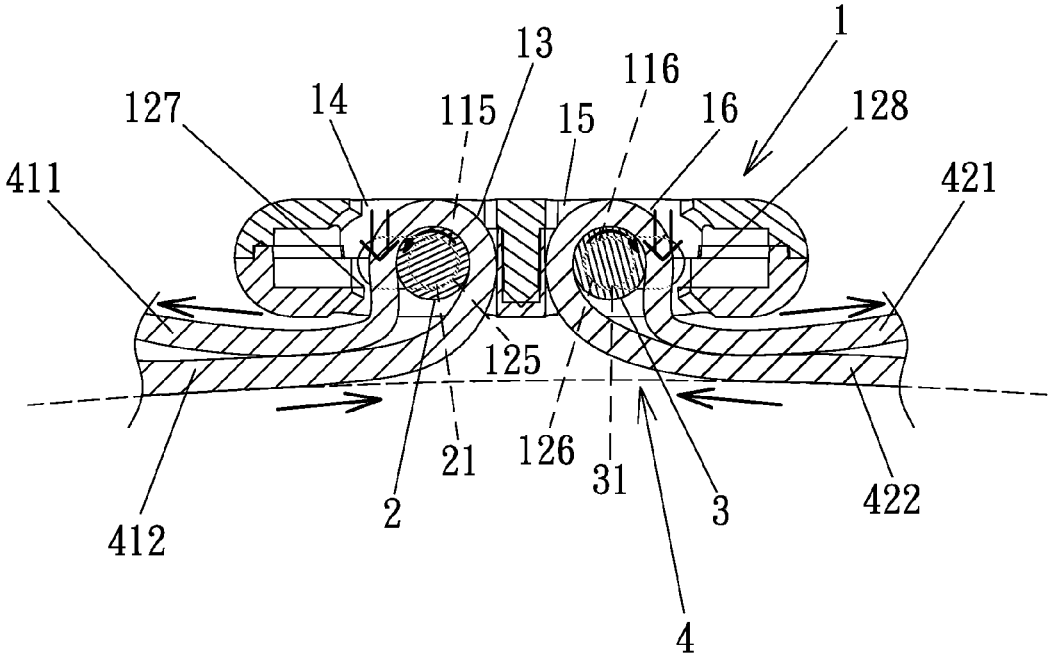
FIG. 6 shows a cross-sectional view of the strap adjusting device and the strap of FIG. 4 with the ends of the strap being pulled to adjust tightness of the strap while the pair of swimming goggles is worn on a head of a user.

Adjustment of the length and tightness of the strap 4 can be carried out when the pair of swimming goggles is worn on the head of the user. With reference to FIG. 6, the user can pull the outer portions 411 and 421 outward (see the arrows) so that the clamping portions 412 and 422 clamp the head of the user to the desired tightness. Each outer portion 411, 421 is stretched at a section that imparts a force to the pressing member 2, 3 in a direction (see the double arrow in FIG. 6) not toward the pressing edge 127, 128. Thus, the pressing member 2, 3 will not move toward the pressing edge 127, 128. Furthermore, the pressing member 2, 3 rotates when the strap 4 is stretched.

Figure 7:
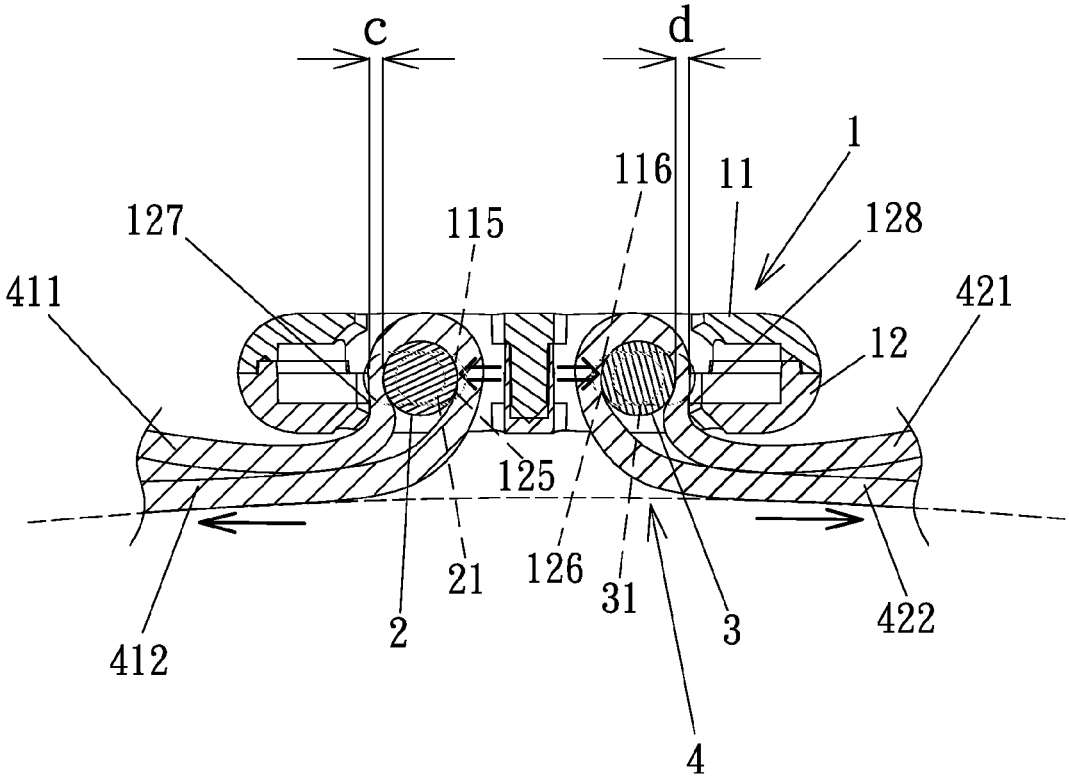
FIG. 7 shows a cross-sectional view of the strap adjusting device and the strap of FIG. 6 with the strap in a tightened state.
Figure 8:
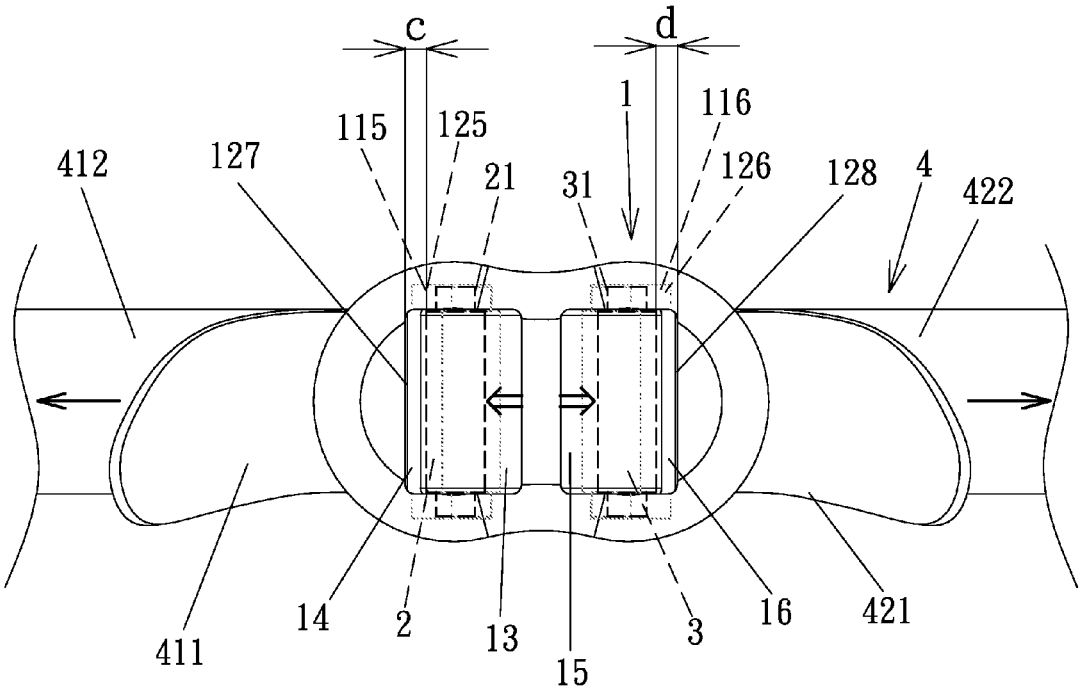
FIG. 8 is a side view of the strap adjusting device and the strap of FIG. 7.

With references to FIGS. 7 and 8, the outer portions 411 and 421 of the strap 4 are released after adjustment. The clamping force of the strap 4 at the clamping portions 412 and 422 respectively move the pressing members 2 and 3 toward the pressing edges 127 and 128 (see the double arrow). Thus, the pressing members 2 and 3 move toward the pressing edges 127 and 128 while the ends 21 and 31 of the pressing members 2 and 3 slide outward in the receiving portions 115, 125, 116 and 126 of the buckle 1. Thus, the distance between each pressing member 2, 3 and the associated pressing edge 127, 128 is reduced (see c and d in FIGS. 7 and 8). As a result, the pressing edges 127 and 128 of the buckle 1 and the pressing members 2 and 3 securely clamp the strap 4 and, thus, fix the length of the strap 4. The larger the pulling force applied to the strap 4, the larger the force is generated for moving the pressing members 2 and 3 toward the pressing edges 127 and 128. Reliable clamping effect is provided for the strap 4 through easy adjustment.

When loosening of the strap 4 is desired, the strap 4 is firstly removed from the head of the user. Then, the user can pull the clamping portions 412 and 422 away from the inner slots 13 and 15 (see FIG. 4) such that the pressing members 2 and 3 will not move toward the pressing edges 127 and 128. Thus, the strap 4 is not pressed and, thus, can be easily loosened by simply pulling the clamping portions 412 and 422.

Figure 9:
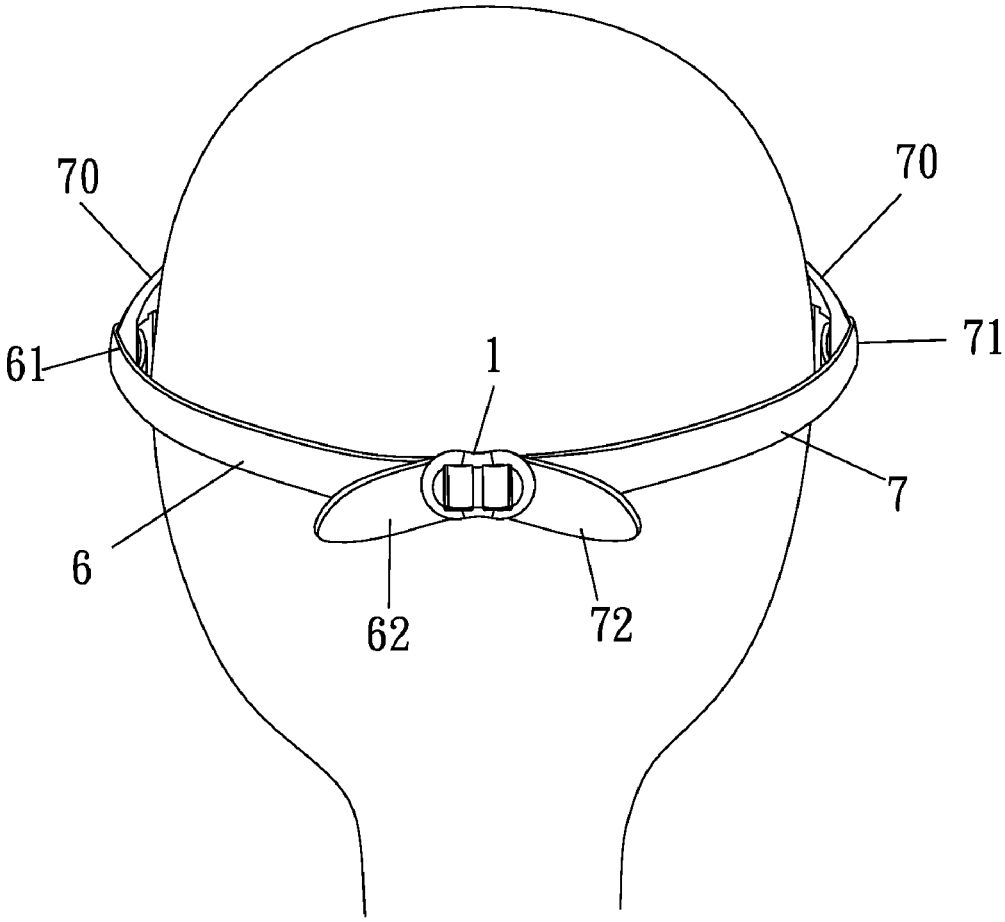
FIG. 9 shows a schematic perspective view of a pair of swimming goggles utilizing the strap adjusting device of FIG. 1 and two straps and worn on a head of a user.

FIG. 9 shows a pair of swimming goggles utilizing the strap adjusting device 1 according to the preferred teachings of the present invention and two straps 6 and 7 each having a first end 61, 71 coupled with a body 70 of the pair of swimming goggles and a second end 62, 72 coupled with the strap adjusting device 1. Operation of the strap adjusting device 1 coupled with two straps 6 and 7 is substantially the same as that coupled with only one strap 4.

Figure 10:
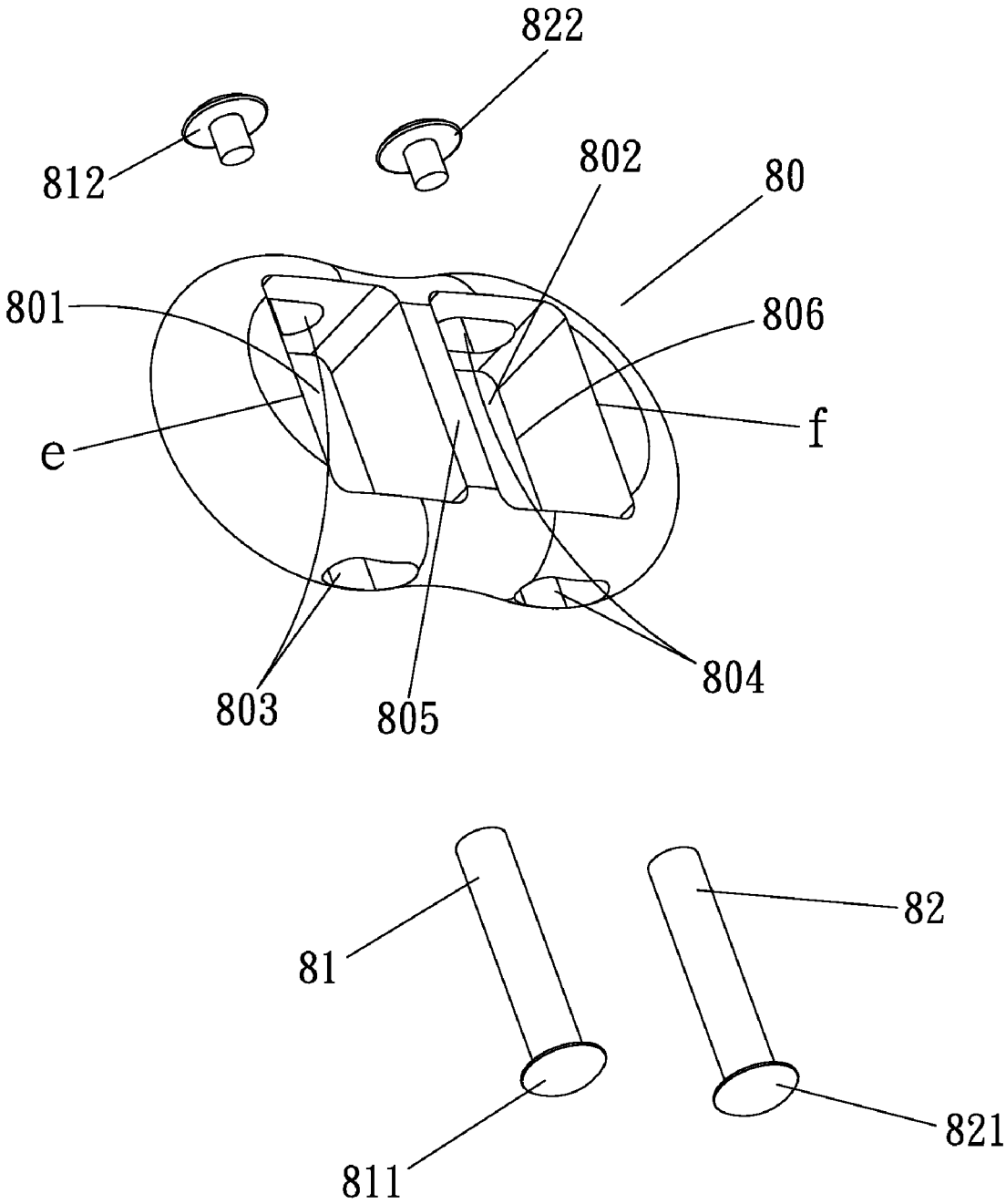
FIG. 10 shows an exploded perspective view of a strap adjusting device of a second embodiment according to the preferred teachings of the present invention.
Figure 11:
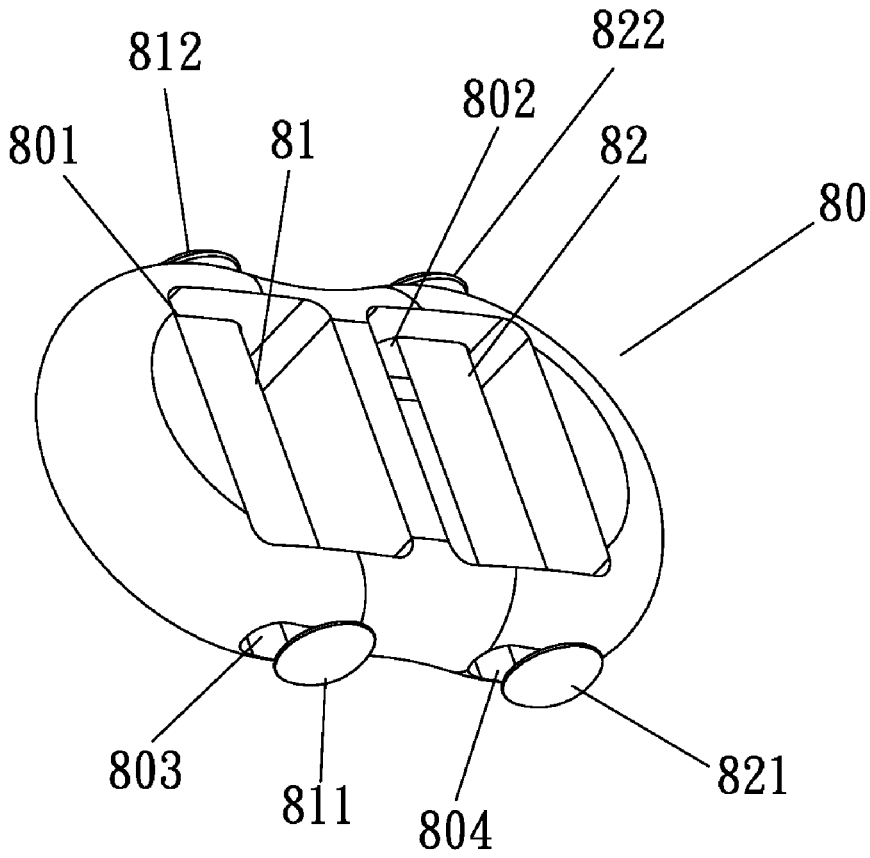
FIG. 11 shows a perspective view of the strap adjusting device of FIG. 10.
Figure 12:
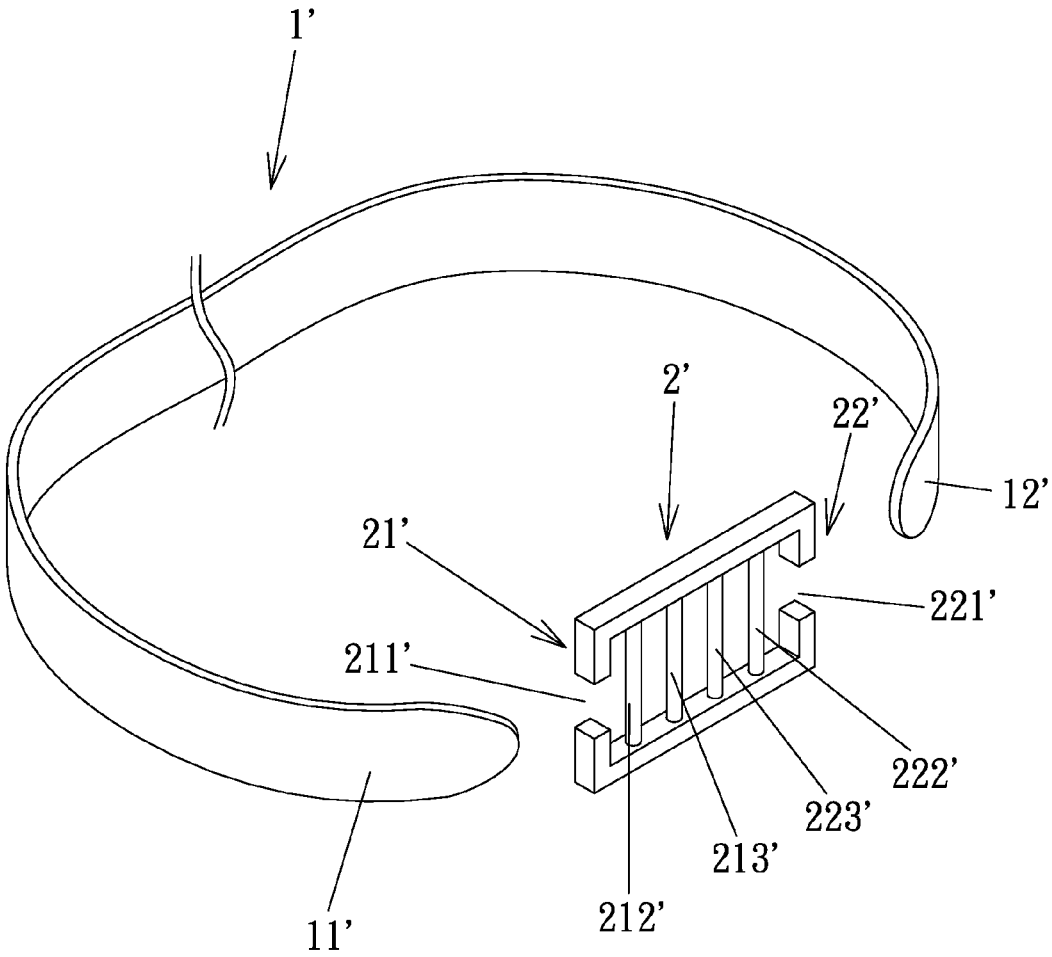
F I G . 12(PRIOR ART)
FIG. 12 shows an exploded perspective view of a strap and a conventional buckle.
Figure 13:
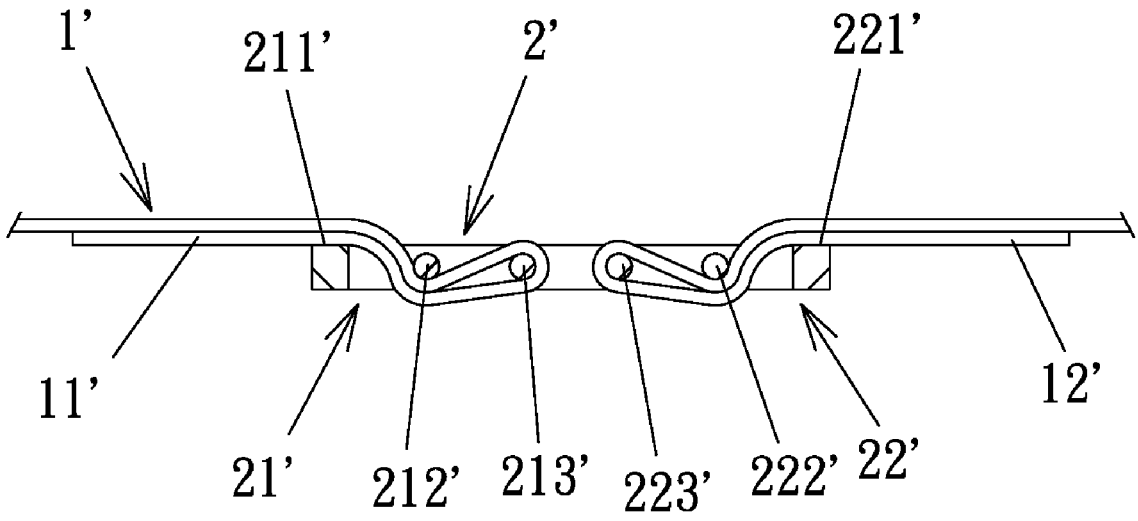
F I G . 13(PRIOR ART)
FIG. 13 shows a partial, side view of the strap and the buckle of FIG. 12 in an assembled state.
Figure 14:
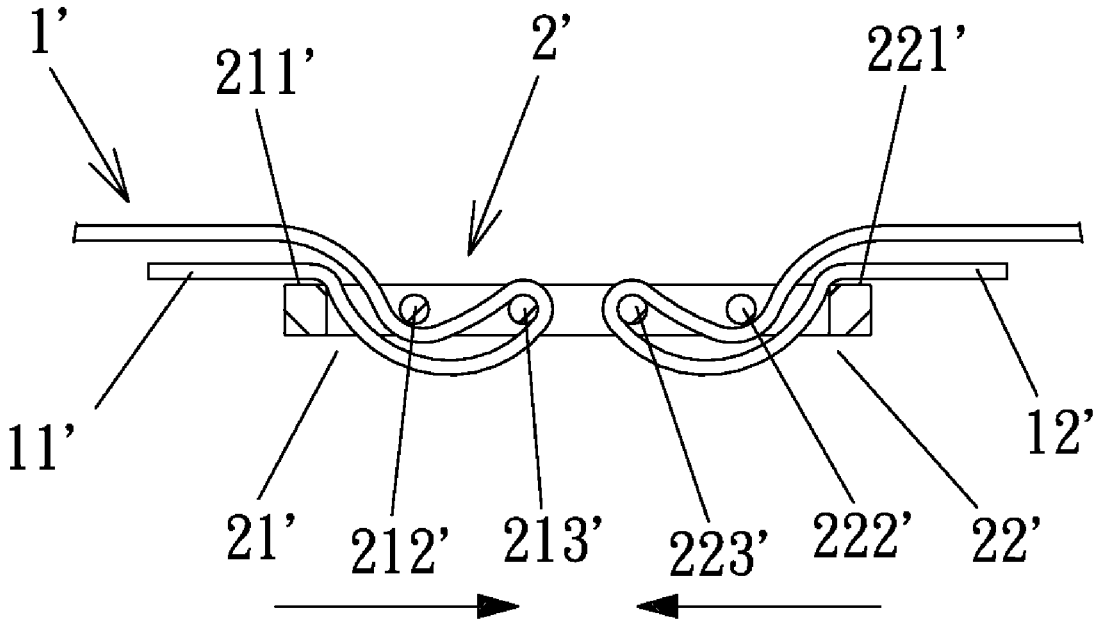
F I G . 14(PRIOR ART)
FIG. 14 shows a partial, side view of the strap and the buckle of FIG. 12, illustrating adjustment of a length of the strap.
Figure 15:
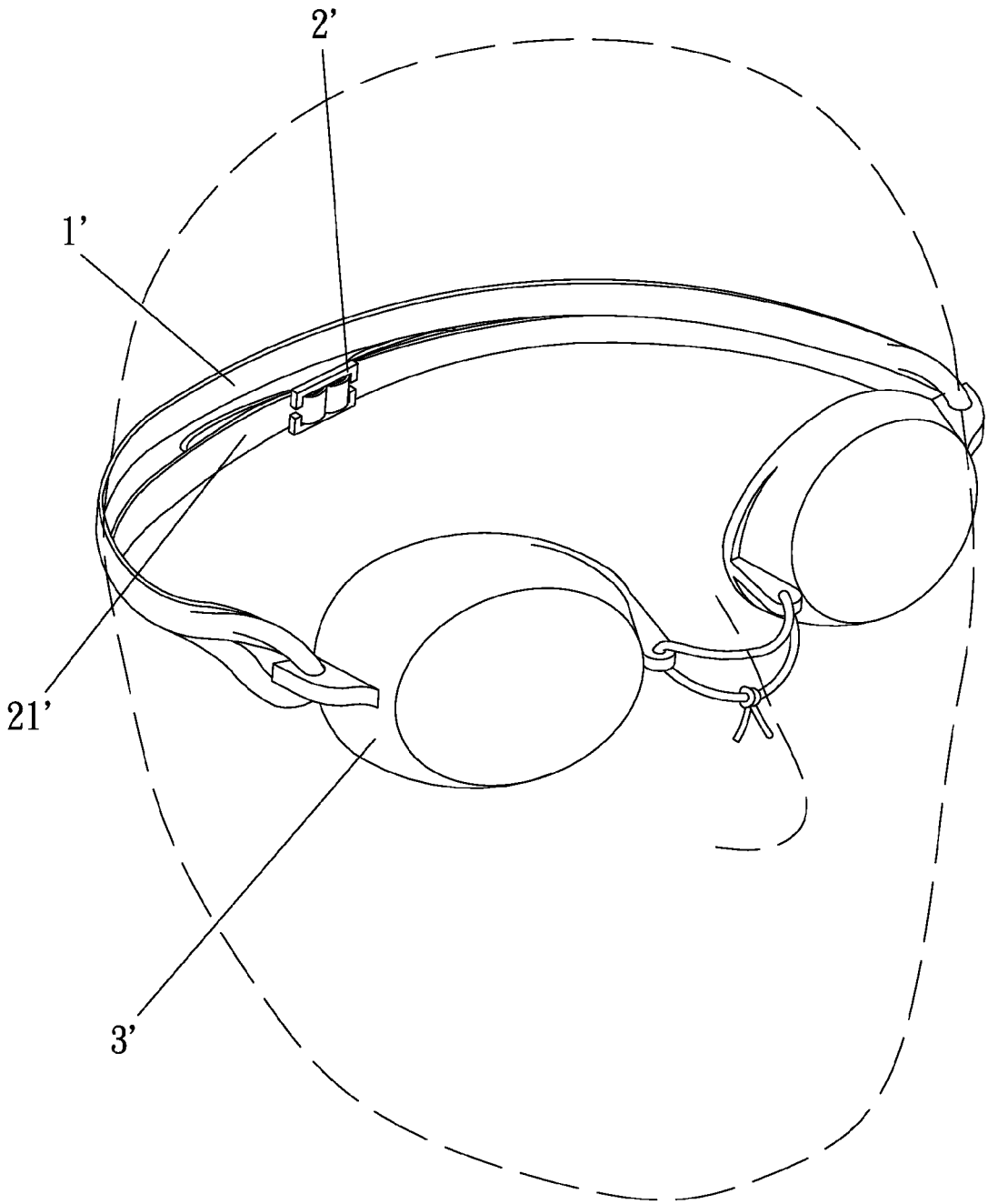
F I G . 15(PRIOR ART)
FIG. 15 shows a schematic perspective view of a pair of swimming goggles utilizing the strap and the buckle of FIG. 12.

FIGS. 10 and 11 show a strap adjusting device of a second embodiment according to the preferred teachings of the present invention. In this embodiment, the buckle (now designated 80) is a single continuous monolithic piece including left and right through-holes 801 and 802 spaced by a partitioning wall 805. The left through-hole 801 includes a receiving portion 803 in each of two opposite sidewalls that define the left through-hole 801 and that are perpendicular to the outer wall (now designated e). The right through-hole 802 includes a receiving portion 804 in each of two opposite sidewalls that define the right through-hole 802 and that are perpendicular to the outer wall (now designated f). Each receiving portion 803, 804 is in the form of an elongated through-hole. Each outer wall e, f includes a pressing edge 806. Two pressing members 81 and 82 are rotatably and slideably engaged with the receiving portions 803 and 804. Each pressing member 81, 82 includes two ends 811, 812, 821, 821 having a width or diameter larger than a width of the receiving portion 803, 803, preventing disengagement of the pressing member 81, 82 from the buckle 80. The buckle 80 can be formed by injection molding. The buckle 80 can couple with a strap in a manner substantially the same as that shown in FIG. 6 or with two straps in a manner substantially the same as that shown in FIG. 9. Operation of the strap adjusting device of the second embodiment is substantially identical to that of the first embodiment mentioned above. Furthermore, the user can directly grip and move the ends 811, 812, 821, 822 of the pressing members 81 and 82 relative to the buckle 80, providing easier adjusting operation of the strap(s) coupled with the buckle 80.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A strap adjusting device for a pair of swimming goggles comprising:

a buckle including first and second through-holes spaced by a partitioning wall, with each of the first and second through-holes including an outer wall facing the partitioning wall and having a pressing edge, with each of the first and second through-holes further including two opposite sidewalls perpendicular to the outer wall, with each of the two sidewalls of the first through-hole including a first receiving portion, with each of the two sidewalls of the second through-hole including a second receiving portion;

first and second pressing members respectively received in the first and second through-holes, with the first pressing member separating the first through-hole into a first inner slot adjacent the partitioning wall and a first outer slot distant to the partitioning wall, with the second pressing member separating the second through-hole into a second inner slot adjacent the partitioning wall and a second outer slot distant to the partitioning wall, with each of the first and second pressing members having two ends, with the two ends of the first pressing member being slideably and rotatably received in the first receiving portions, with the two ends of the second pressing member being slideably and rotatably received in the second receiving portions, with the first and second pressing members being movable relative to the buckle to adjust a distance between each of the first and second pressing members and one of the pressing edges; and at least one resilient strap adapted to be mounted to a body of a pair of swimming goggles and including two ends, with one of the two ends of said at least one resilient strap being extended through the first inner slot and the first outer slot and wound around the first pressing member, with another end of said at least one resilient strap being extended through the second inner slot and the second outer slot and wound around the second pressing member, with said at least one resilient strap including first and second outer portions respectively adjacent the two ends of said at least one resilient strap, and with said at least one resilient strap further including first and second clamping portions adapted for clamping a head of a user wearing the pair of swimming goggles, with the first and second outer portions being pullable by a force to adjust tightness of the strap when the pair of swimming goggles is worn on the head of the user, with the force acting on the strap urging each of the first and second pressing members to move toward one of the pressing edges to tightly clamp the strap and to fix a length of the strap.

2. The strap adjusting device for the pair of swimming goggles as claimed in claim 1, with the pressing edge including a pointed section.

3. The strap adjusting device for the pair of swimming goggles as claimed in claim 1, with one of the two ends of said at least one resilient strap being extended through the first inner slot, around the first pressing member, and then extended out of the buckle via the first outer slot, and with the other end of said at least one resilient strap being extended through the second inner slot, around the second pressing member, and then extended out of the buckle via the second outer slot.

4. The strap adjusting device for the pair of swimming goggles as claimed in claim 1, with each of the first and second receiving portions being an elongated groove, with the first and second pressing members being made of a rigid material, and with the two ends of each of the first and second pressing members being slideably and rotatably received in the elongated grooves.

5. The strap adjusting device for the pair of swimming goggles as claimed in claim 3, with the two ends of each of the first and second pressing members being cylindrical, and with the two ends of each of the first and second pressing members rotating in the first and second receiving portions when adjusting the tightness of said at least one strap.

6. The strap adjusting device for the pair of swimming goggles as claimed in claim 1, with the buckle including upper and lower portions coupled with each other, with the upper portion including left and right through-holes spaced by a first partitioning wall portion, with the lower portion including left and right through-holes spaced by a second partitioning wall portion, with the left through-holes of the upper and lower portions forming the first through-hole of the buckle, with the right through-holes of the upper and lower portions forming the second through-hole of the buckle, with the first and second partitioning wall portions of the upper and lower portions forming the partitioning wall of the buckle, with one of the upper and lower portions including a protrusion, and with another of the upper and lower portions including a hole receiving the protrusion.

7. The strap adjusting device for the pair of swimming goggles as claimed in claim 1, with the buckle being a single continuous monolithic piece, with each of the first and second receiving portions being an elongated through-hole, with each of the two ends of the first and second pressing members having a width larger than that of the elongated through-hole, preventing the first and second pressing members from disengaging from the buckle.

* * * * *